United States Patent [19]

Amancharla

[11] 4,258,787

[45] Mar. 31, 1981

[54] SUBTERRANEAN WELL INJECTION APPARATUS

[75] Inventor: Amareswar Amancharla, League City, Tex.

[73] Assignee: Baker International Corporation, Orange, Calif.

[21] Appl. No.: 56,574

[22] Filed: Jul. 11, 1979

[51] Int. Cl.[3] ..... E21B 33/129; E21B 34/08; E21B 43/12

[52] U.S. Cl. ..... 166/120; 166/131; 166/212; 166/313

[58] Field of Search ..... 166/120, 122, 131, 134, 166/149, 313, 319

[56] References Cited

U.S. PATENT DOCUMENTS

| | | | |
|---|---|---|---|
| 2,850,099 | 9/1958 | Brown | 166/313 |
| 2,870,843 | 1/1959 | Rodgers, Jr. | 166/313 X |
| 2,944,602 | 7/1960 | Brown | 166/313 |
| 3,045,754 | 7/1962 | Myers | 166/313 UX |
| 3,223,169 | 12/1965 | Roark | 166/120 |
| 3,333,639 | 8/1967 | Page et al. | 166/120 |
| 3,765,483 | 10/1973 | Vencil | 166/313 X |

*Primary Examiner*—Stephen J. Novosad
*Attorney, Agent, or Firm*—William C. Norvell, Jr.

[57] ABSTRACT

An apparatus is provided for injecting fluid within the bore of a subterranean well. The fluid is transmitted through the bore above the apparatus through parallel fluid flow conduits. A packer assembly communicates to the fluid flow conduits and is carriable on at least one of the conduits. Concentric flow means are defined through the packer assembly for transmission of fluid and communicate with the fluid flow conduits and a production zone within the well. Receptacle means are carried on the packer assembly and communicate between the fluid flow conduits and the concentric flow means. Casing gripping means which are fluid pressure responsive are defined around the packer assembly and are responsive to each of predeterminable pressure increase from fluid flow from the top of the well within one of the fluid flow conduits and within the well below the packer assembly, whereby the gripping means are urged to gripping engagement with the casing to prevent movement of the apparatus in one direction.

4 Claims, 9 Drawing Figures

SUBTERRANEAN WELL INJECTION APPARATUS

BACKGROUND OF THE INVENTION

1. Field of the Invention

The invention relates to an apparatus for the injection of corrosion or other inhibitor, or gas for artificial lift purposes, utilizing an apparatus having a packer assembly concentrically receiving parallel fluid flow conduits extending above the packer assembly, the packer assembly having selectively activatable hold-down buttons, or casing gripping means, which may be activated by pressure defined through the fluid carried through one of the fluid flow conduits from the top of the well.

2. Description of the Prior Art

During the production of a subterranean oil well, it may be necessary to artifically lift the production fluid from the production zone, because the pressure within the well is insufficient to transmit the produced fluids to the top of the well, without auxiliary or artificial lift means. In such instances, gas is selectively injected into the well by means of a conventionally activated valve apparatus carried within a side pocket mandrel on a fluid flow conduit for injection into or slightly below the zone to urge the production fluid to the top of the well through a production string. The gas may be injected into the valve through the annular area between the tubing and the casing. Alternatively, a "short" or "injection" string may extend from the top of the well to the production zone, without incorporation of the valve and side pocket mandrel.

During the production of a subterranean well, in many instances, it will be desirable to inject a corrosion or other inhibitor with the produced fluid to prevent corrosion to component parts of the completion and production assembly within the well. Such inhibitor generally is injected to the production zone through a "short" tubing string, or through the tubing-casing annulus for injection through a packer assembly sealingly engaged within the casing and above the production zone, thence through the lowermost exterior end of the packer, and with the production fluid through the production or "long" string, to the top of the well.

The utilization of parallel tubing strings through a packer assembly of necessity reduces the diameter of each string, and adversely affects the carriable production volume of the production or "long" string. Therefore, it would be most desirable for parallel tubing strings to become concentrically mounted through the packer assembly, in order to afford maximum internal diameter for the production string.

The present invention provides such concentric mounting of the tubing strings within a packer assembly, and also provides selectively activatable casing gripping means to assure sealing engagement of the packer apparatus in the bore of the well above the production zone. Additionally, the present invention provides a packer assembly which comprises casing gripping, selectively activatable, fluid responsive hold-down buttons which may themselves be activated into gripping engagement with the casing by transmission of the inhibitor or other fluid through the concentrically mounted tubing strings within the packer assembly, from the top of the well.

SUMMARY OF THE INVENTION

The present invention is directed to an apparatus for injecting fluid within the bore and immediate a production zone of a subterranean well, with the well having casing extending therein. The fluid is transmitted through the bore above the apparatus through parallel fluid flow conduits. The apparatus comprises a packer assembly which communicates to the fluid flow conduits and is carriable by at least one of the conduits. Concentric flow means through the packer transmit fluid and communicate with the fluid flow conduits and the production zone. Receptacle means defined on the packer assembly communicate between the fluid flow conduits and the concentric flow means. Fluid pressure responsive casing gripping means are circumferentially extended around the packer assembly and are responsive to each of predeterminable pressure increase from fluid flow from the top of the well within one of the fluid flow conduits and within the well below the packer assembly, whereby the gripping means are urged to gripping engagement with the casing to prevent movement of the apparatus in one direction. In one form, the apparatus is provided with side pocket mandrel and valve means on one of the fluid flow conduits for selective and incremental injection therein of fluid, such as corrosion inhibitor, or a gaseous substance for increase of pressure immediate the production zone to artificially lift the produced fluid from the zone through the apparatus and to the top of the well.

DESCRIPTION OF THE PREFERRED EMBODIMENTS

Figure 1A:
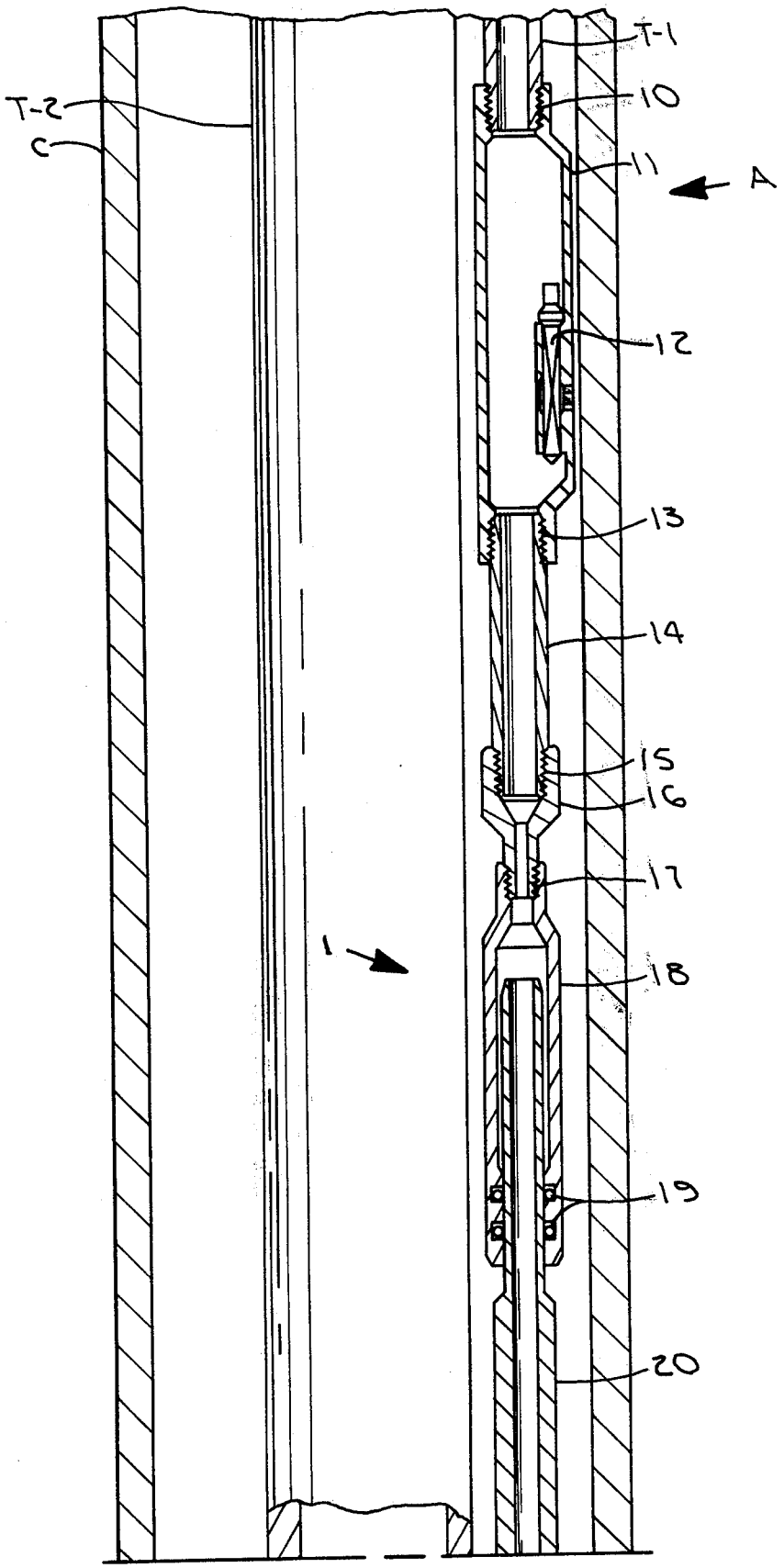
FIGS. 1A, 1B and 1C together constitute an extended longitudinal sectional view of the apparatus of the present invention inserted immediate a production zone in a subterranean well, prior to the setting of the packer assembly.
Figure 1B:
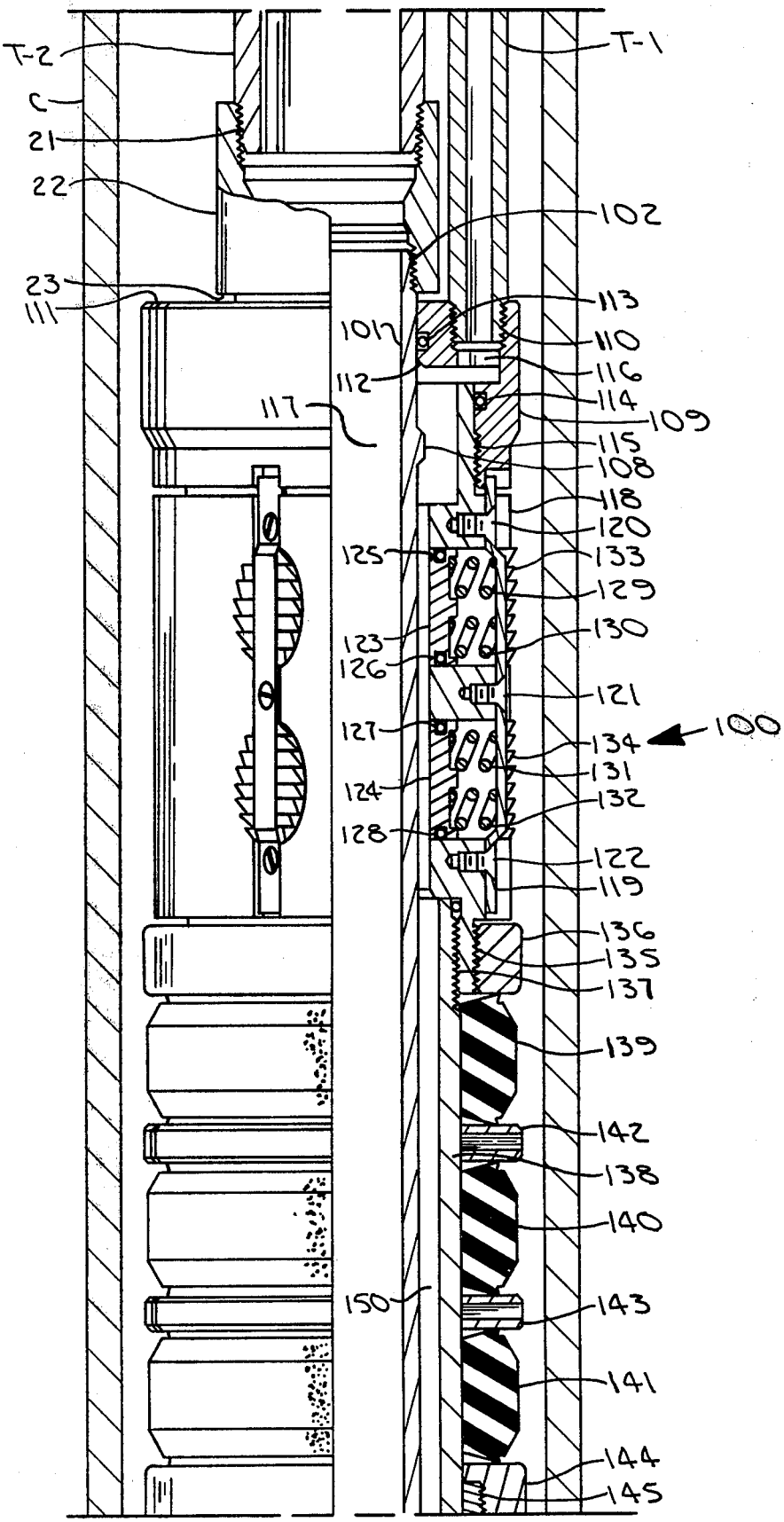
Figure 1C:
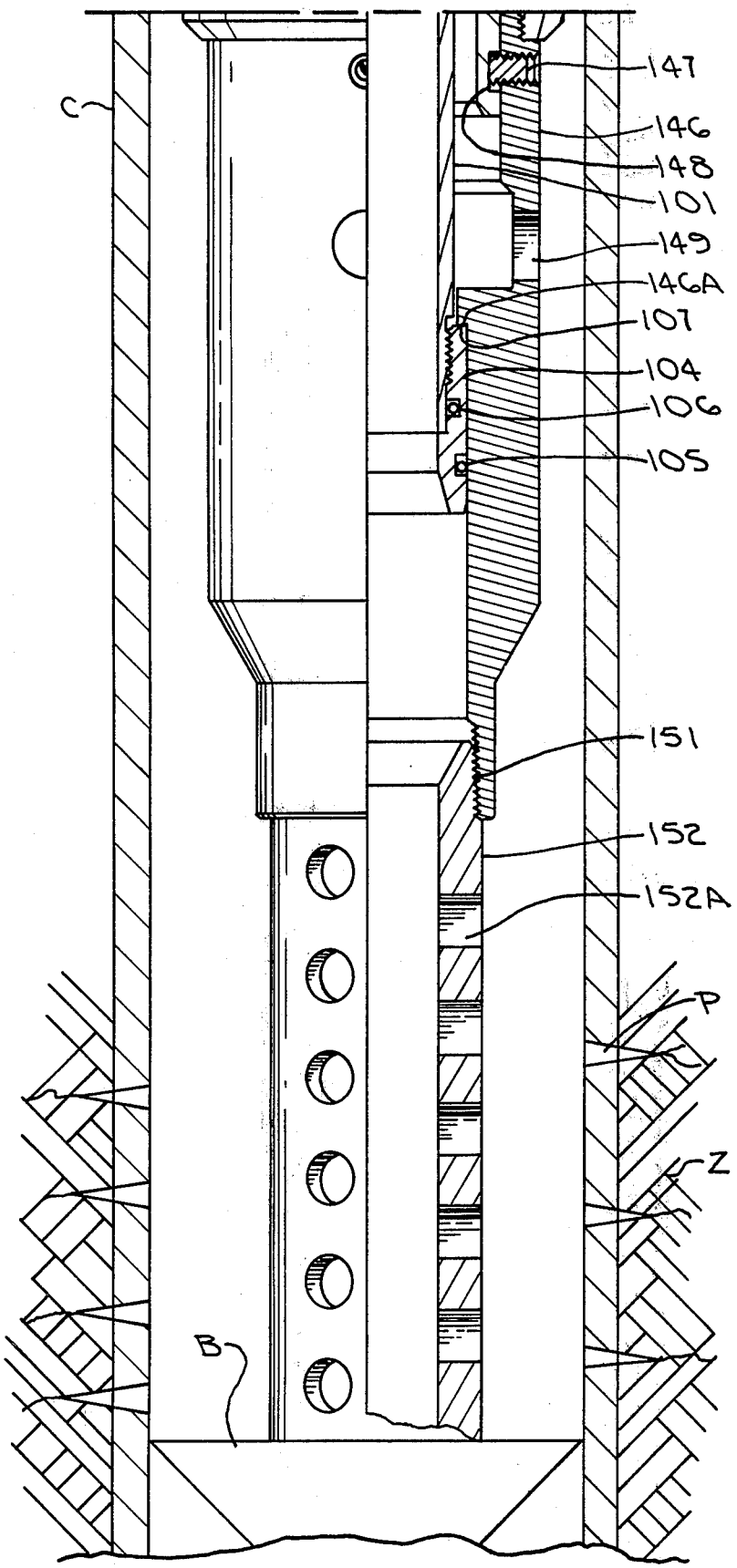

Now first referring to FIGS. 1A, 1B and 1C, the apparatus A generally comprises an upper section 1 and a packer assembly 100 secured thereto and extending therebelow. The apparatus A no-go's in a downward direction by having its lowermost end resting upon the bottom of the well B or upon the top of a second or auxiliary packing element, bridge plug, or the like (not shown). The well has casing C extending therein and to the zone Z, with perforations P being transversely extended through the casing C for communication from the zone Z to the interior of the casing C, for transmission of the fluid hydrocarbons from the well, through the apparatus A, thence to the top of the well.

The apparatus A is affixed at its uppermost end to a short tubing string T-1, which extends to the top of the well. A side pocket mandrel 11, of conventional and known construction, is affixed to the short string T-1 by means of threads 10. A conventional gas lift valve 12 is carried in an offset within the side pocket mandrel 11. The valve 12 is utilized to inject gas or inhibitor from the top of the well through the side pocket mandrel 11 and the short string T-1 therebelow to the packer assembly 100 only when such gas or inhibitor is injected from the top of the well through the annular area between the strings T-1 and T-2, and the casing C. It is not necessary to incorporate a side pocket mandrel 11 or a valve 12 on the short string T-1, when the gas or inhibitor is to be injected from the top of the well within the short string T-1, and not within the tubing-casing annular area described above.

A short tubing section 14 is secured to the lowermost end of the side pocket mandrel 11 by means of threads 13, the tubing section 14 being affixed at its lowermost end by means of threads 15 to a coupling 16. An expansion joint having an upper expansion mandrel 18 is secured to the coupling 16 at threads 17, the mandrel 18 having conventional elastomeric O-ring seal elements 19 thereon for sliding engagement on the exterior smooth surface of a companion lower expansion mandrel 20 telescopically received within the upper expansion mandrel 18. It will be appreciated that, in some instances, it will not be necessary to utilize any such expansion joint. Rather, the side pocket mandrel 11 may be affixed directly to the packer assembly 100, by known means.

A production or "long" string T-2 extends from the top of the well through the casing C and is mounted in parallel relationship to the "short" tubing string T-1 above the packer assembly 100. The long string T-2 is secured at threads 21 to a coupling 22 which, in turn, has a lower face 23 for selective interengagement of a companion upper face 111 carried on the packer assembly 100, during the setting operation, described below.

The coupling 22 is secured to a longitudinally extending long string mandrel 101 within the packer assembly 100, by means of threads 102. At the lowermost end of the long string mandrel 101 and secured thereto at threads 103 is a bottom cap member 104 having an upwardly facing circumferentially extending shoulder 107 thereon for interface with a companionly defined shoulder 146A on the lower mandrel 146, during retrieval of the packer assembly 100 from the well, described below. The bottom cap 104 also defines a circumferentially extending elastomeric O-ring seal element 106 to prevent fluid communication between the bottom cap 104 and the long string mandrel 101. Additionally, a similarly shaped elastomer ring 105 also is carried on the bottom cap 104 to prevent fluid communication between the cap 104 and the lower mandrel 146.

The long string mandrel 101 also defines immediate its uppermost end an outwardly extending profiled pick-up shoulder 108 which, upon upward longitudinal manipulation of the long string T-2 is moved to interengagement position with a companionly shaped lower bevel 112 on a dual string receptacle 109, the duel string receptacle 109 having threads 110 for receipt of the lower expansion mandrel 20, through a bore 116 in the receptacle 109.

The receptacle 109 also has an enlarged central bore 117 for carriage of the long string mandrel 101 through the packer assembly 100, the mandrel 101 being secured and communicating to the long string T-2. An upper face 111 is defined on the dual string receptacle 109 for selective interface with the companion lower face 23 of the coupling 22 securing the long string mandrel 101 to the long string T-2, the interface between the faces 23–111 occuring as set-down weight is applied through the long string T-2, to set the packer assembly 100.

An elastomer O-ring seal element 113 is carried around the interior of the dual string receptacle 109 to prevent fluid communication between the receptacle 109 and the long string mandrel 101. A similarly contoured elastomer ring 114 also is carried on the dual string receptacle 109 to prevent fluid communication between the receptacle 109 and the hydraulic hold-down assembly 118 secured to the dual string receptacle 109 by means of threads 115.

The hydraulic hold-down assembly 118 is elongated and extends between the dual string receptacle 109 at its uppermost end and a top gauge ring 136 at its lowermost end. A plurality of circumferentially spaced leaf springs 119 are carried within the hydraulic hold-down assembly 118 and are secured thereto by screws 120, 121 and 122. Interior of the leaf springs 119 are a plurality of sectioned upper and lower teeth elements 133 and 134 for urgable extension away from the packer assembly 100 to gripping engagement with the inner wall of the casing C by means of increased pressure being exerted upon companion fluid activatable piston elements 123 and 124.

The piston element 123 is held in normally and inwardly retracted position by the compressive force defined through spring elements 129, 130 extending between the outer face of the piston 123 and the interior of the teeth 133. The piston 123 also houses the elastomeric ring elements 125 and 126 to prevent fluid communication between the piston 123 and the hydraulic hold-down assembly 118.

Similarly, the piston 124 is urged inwardly by the compressive force defined through springs 131 and 132. The springs 131–132 also are urged against the outermost face of the piston 124 and are housed within the hydraulic hold-down assembly 118 between the piston 124 and the lower teeth components 134. Elastomer ring elements 127 and 128 are housed within the piston 124 to prevent communication of fluid between the piston 124 and the hydraulic hold-down assembly 118.

The lowermost end of the hydraulic hold-down assembly 118 is secured at threads 135 to a top gauge 136 for compression of the packing elements of the packer assembly as it is urged into sealing engagement with the casing C.

The hydraulic hold-down assembly 118 also is secured at its lowermost end to a longitudinally extending interior packer mandrel 138 secured to the hold-down assembly 118 at threads 137. The packer mandrel 138 longitudinally extends within the exteriorly and circumferentially extending packing elements 139, 140 and 141, made of conventional elastomeric material. The packing elements 139 and 140 are separated one from another by a spacer 142, and the packing elements 140 and 141 also are separated one from another by a similar spacer element 143. The packing elements 139, 140 and 141 are held in place relative to the packer mandrel 138 by means of a lower gauge ring 144 which assists in compressing the packing elements 139, 140 and 141 into sealing engagement with the casing C. The lower gauge ring 144 is secured at threads 145 to a longitudinally extending lower mandrel 146 which is secured to the packer mandrel 138, selectively, by means of a shearable pin element 147 partially housed within a groove 148 defined circumferentially around the exterior of the packer mandrel 138. A port 149 is bored transversely through the lower mandrel 146 for communication to the annular area below the packing elements between the casing C and the apparatus A, the port 149 communicating with a longitudinally extending passageway 150 between the packer mandrel 138 and the long string mandrel 101 for communication of fluid pressure for activation upon the interior face of the pistons 123–124 to overcome the resistance against outwardly extending travel of the pistons 123–124 by the springs 129, 130, 131 and 132.

The lower mandrel 146 is secured to a bottom sub 152 by means of threads 151, the bottom sub 152 resting in no-go downward position upon the bottom B of the well and communicating to the perforations P by ports 152A or the like.

OPERATION

When it is desired to artificially lift production from within the zone Z through the well to the top thereof, or to inject inhibitor, the apparatus A is run within the casing C until the lowermost end of the bottom sub 152 no-go's with respect to the bottom B of the well. Thereafter, the packer assembly 100 of the apparatus A is sealingly engaged with respect to the inner wall of the casing C by applying tubing weight on the long string T-2, such that the lower face 23 of the coupling 22 interfaces with the upper face 111 of the dual string receptacle 109. Now, the downward force defined through the tubing weight on the long string T-2 is transferred from the coupling 22 to the dual string receptacle 109, through the hydraulic hold-down assembly 118 affixed thereto, thence through the packer mandrel 138. As the weight continues to be applied through the long string T-2, the strength of the shear pin 147 will be overcome, causing it to shear, and permitting the packer mandrel 138, and its inter-related parts to move downwardly longitudinally with respect to the stable and non-moving lower mandrel 146 and bottom sub 152.

Now, the tubing weight defined though the long string T-2 will act upon the gauge ring 136 and the packer mandrel 138, together with their interengaged parts, to compress the packing elements 139, 140 and 141 until they are sealingly engaged with the wall of the casing C, the lower gauge ring 144 assisting in compression of the packing elements 139, 140 and 141 because of interengagement with the lower mandrel 146 and bottom sub 152 which are no-go'd on the bottom B of the well.

Figure 2A:
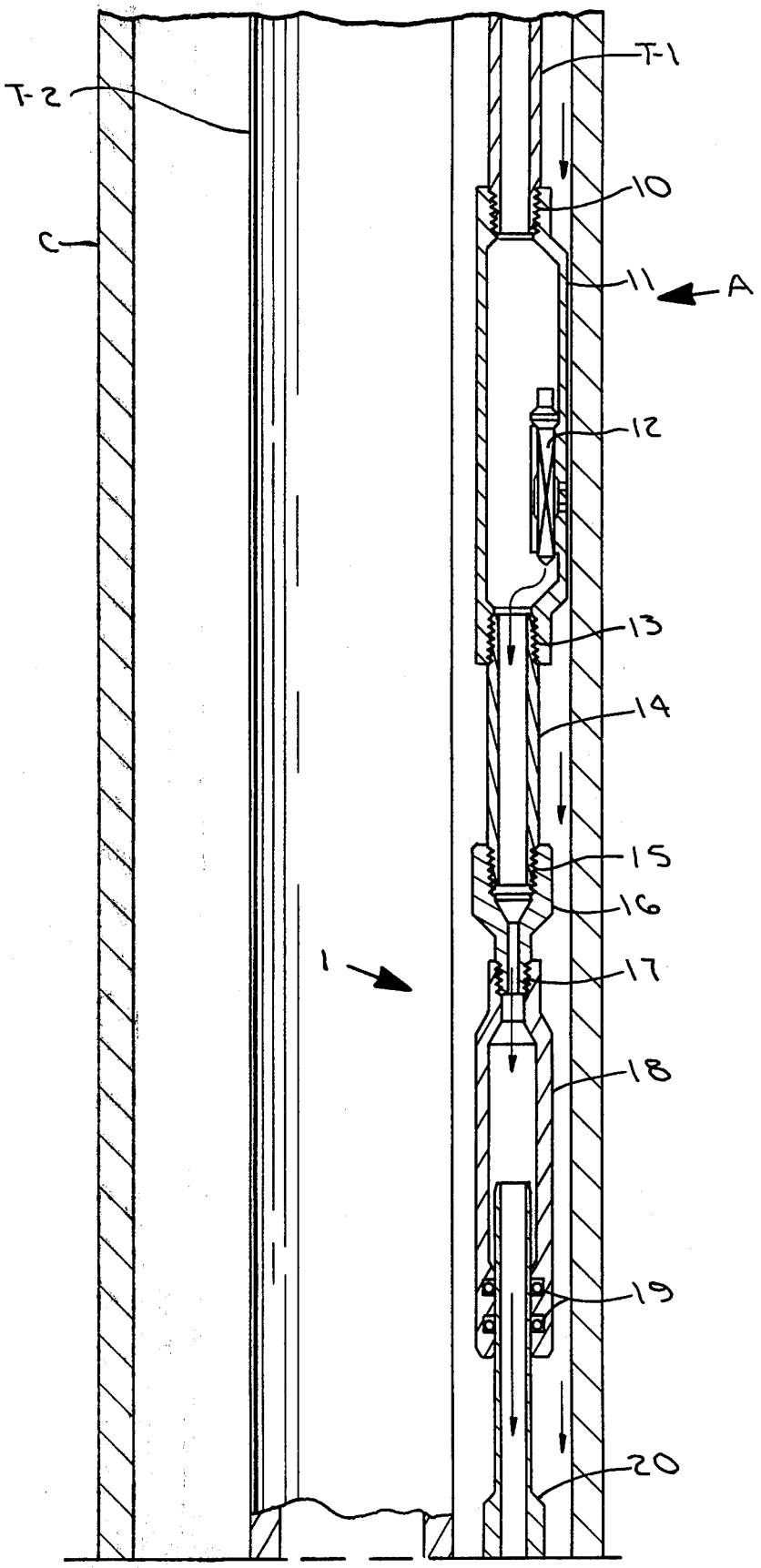
FIGS. 2A, 2B and 2C are views similar to those of FIGS. 1A, 1B and 1C, illustrating the packer apparatus in sealed relation with the casing, the fluid flow path and production flow path being indicated by arrows.
Figure 2B:
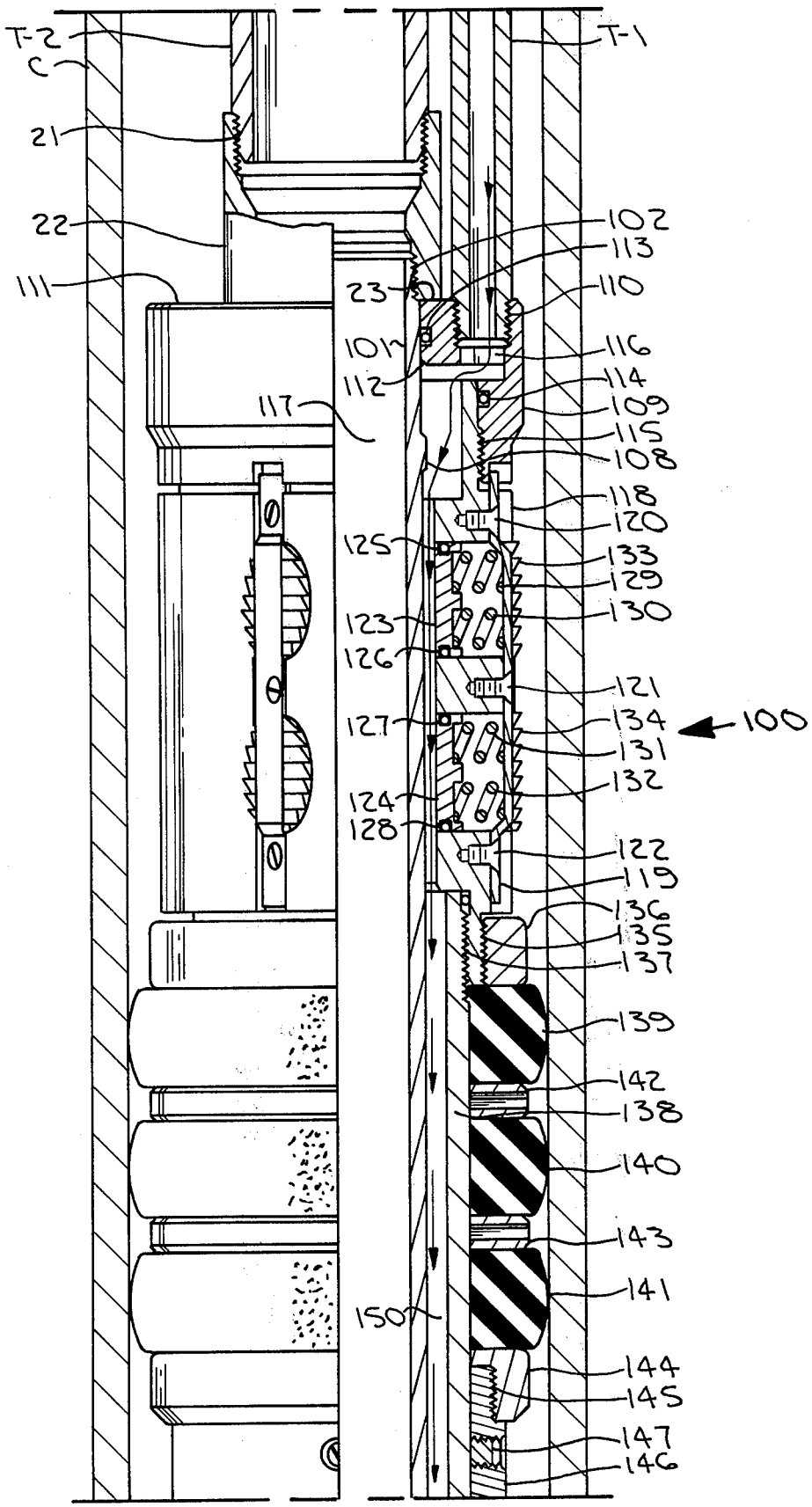
Figure 2C:
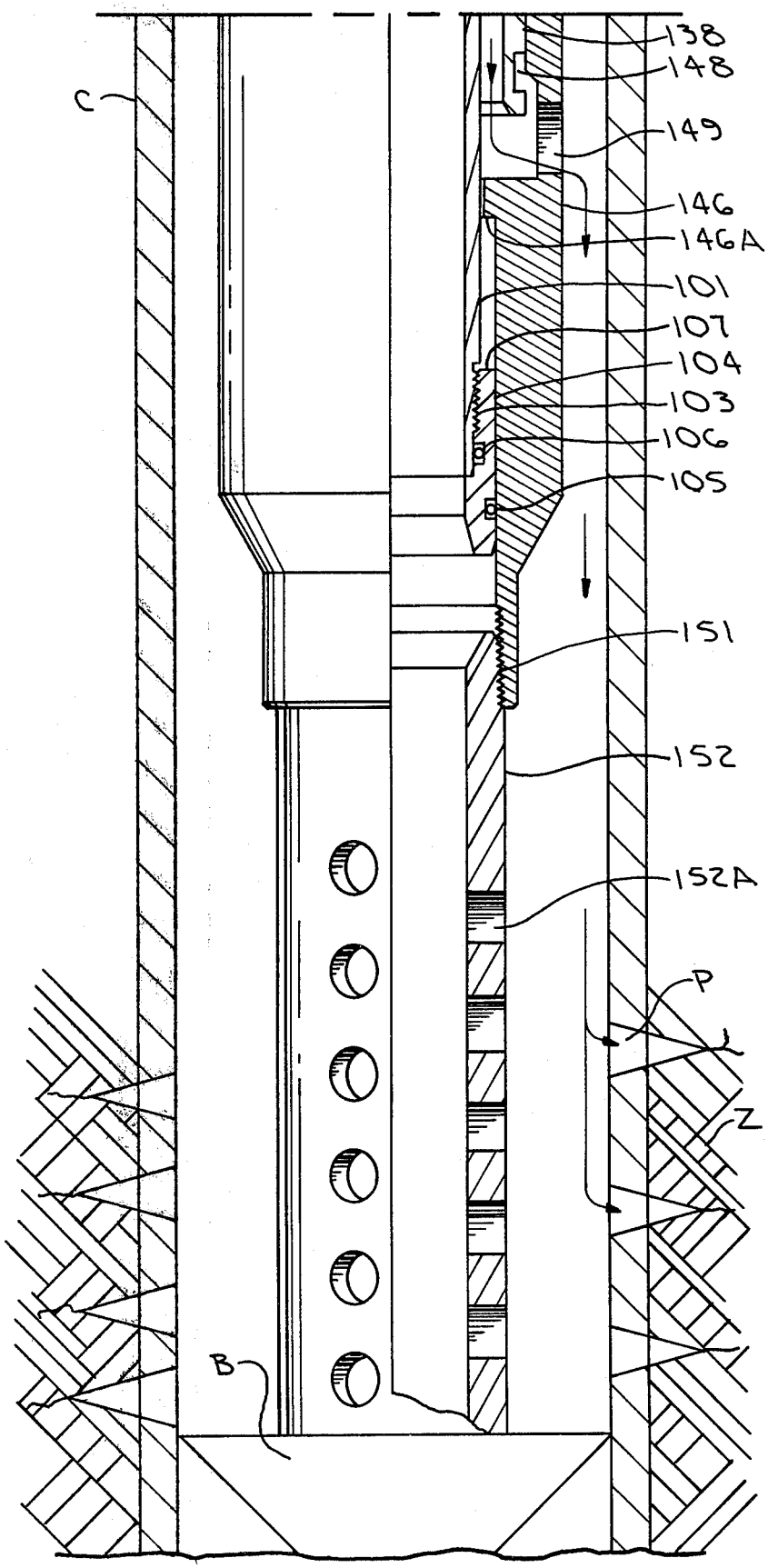

After the packer assembly 100 has been sealingly engaged onto the inner wall of the casing C, the artificial lift fluid may be injected through the valve 12, or, alternatively, directly through the short string T-1 and through the bore 116 of the packer assembly 100 into the passageway 150, thence through the port 149 in the lower mandrel 146 to then be combined with the production fluid entering the well through the perforations P from the zone Z and comingled therewith for transmission to the top of the well through the bores 152A in the bottom sub 152, thence through the interior of the long string mandrel 101 in the packer assembly 100, to the top of the well through the long string T-2. Since the production string T-2 is concentrically defined through the packer assembly 100, increased production volume can be achieved over conventional hookups and production assemblies. The flow paths for the lifting fluid and the production fluid are indicated in FIGS. 2A, 2B and 2C by arrows.

Figure 3A:
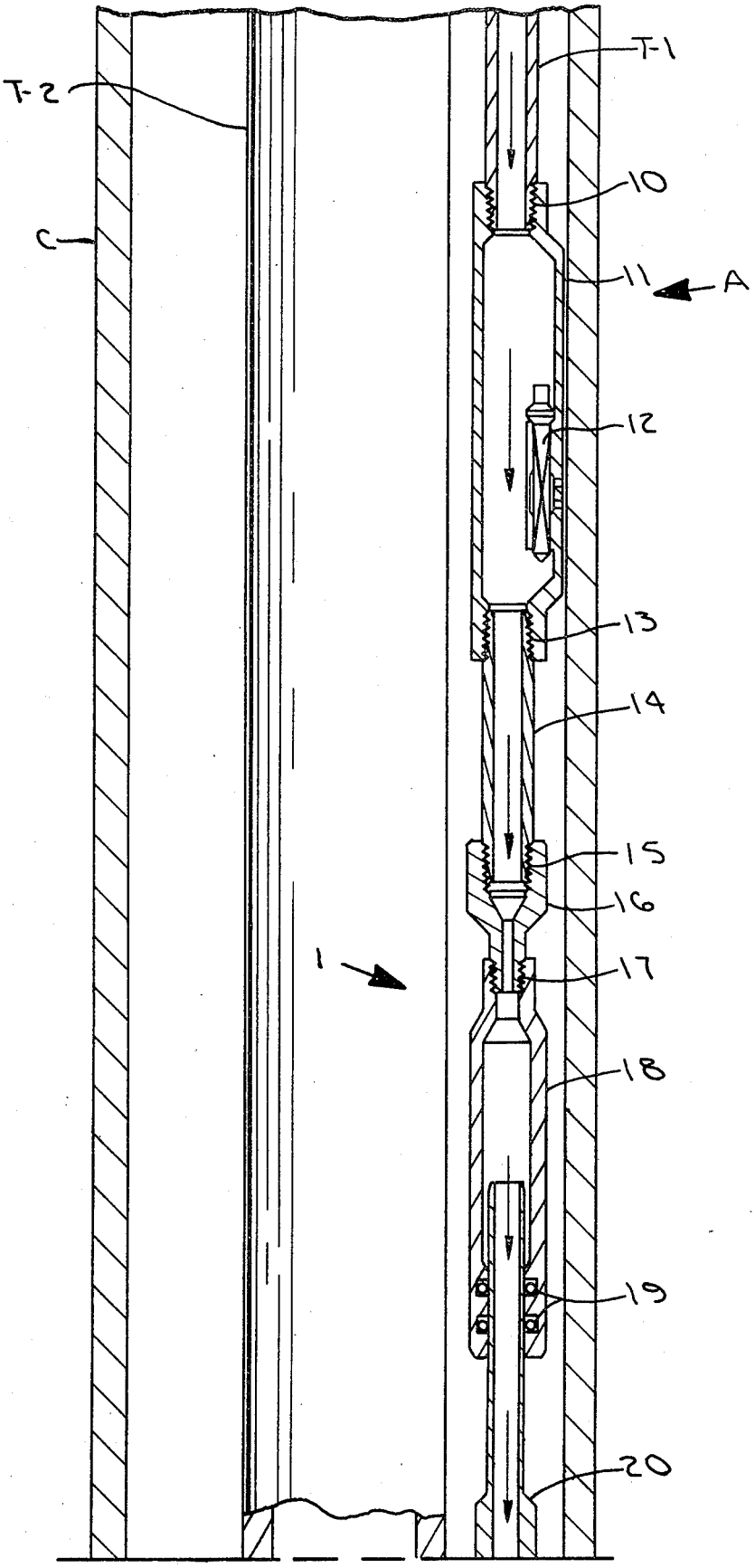
FIGS. 3A, 3B and 3C together constitute an extended longitudinal view similar to the views described above, illustrating the apparatus of the present invention with the casing gripping means, or hold-down buttons in anchored engagement onto the inner wall of the casing of the well, the buttons being urged outwardly by fluid transmitted from the top of the well through the packer assembly.
Figure 3B:
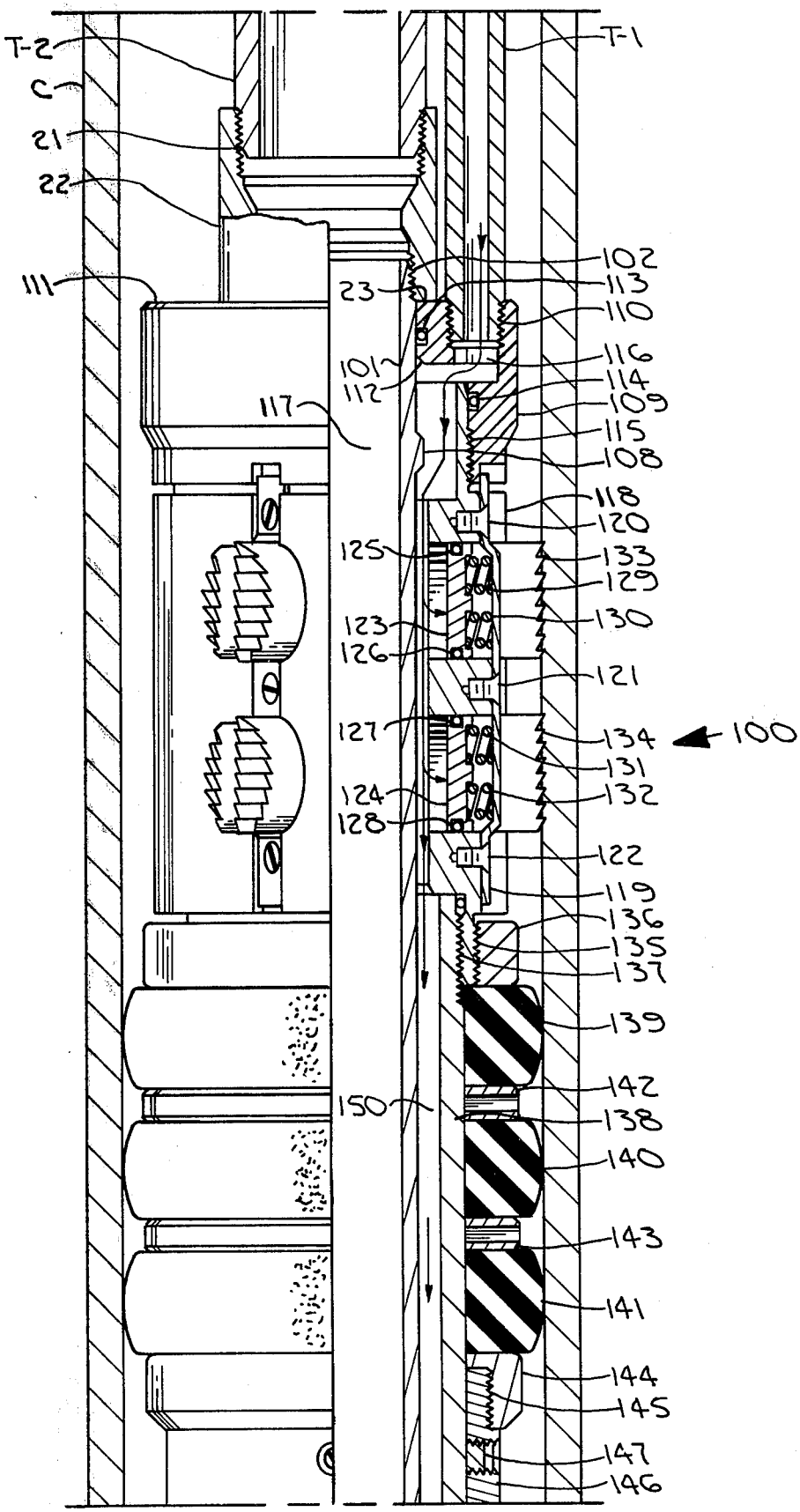
Figure 3C:
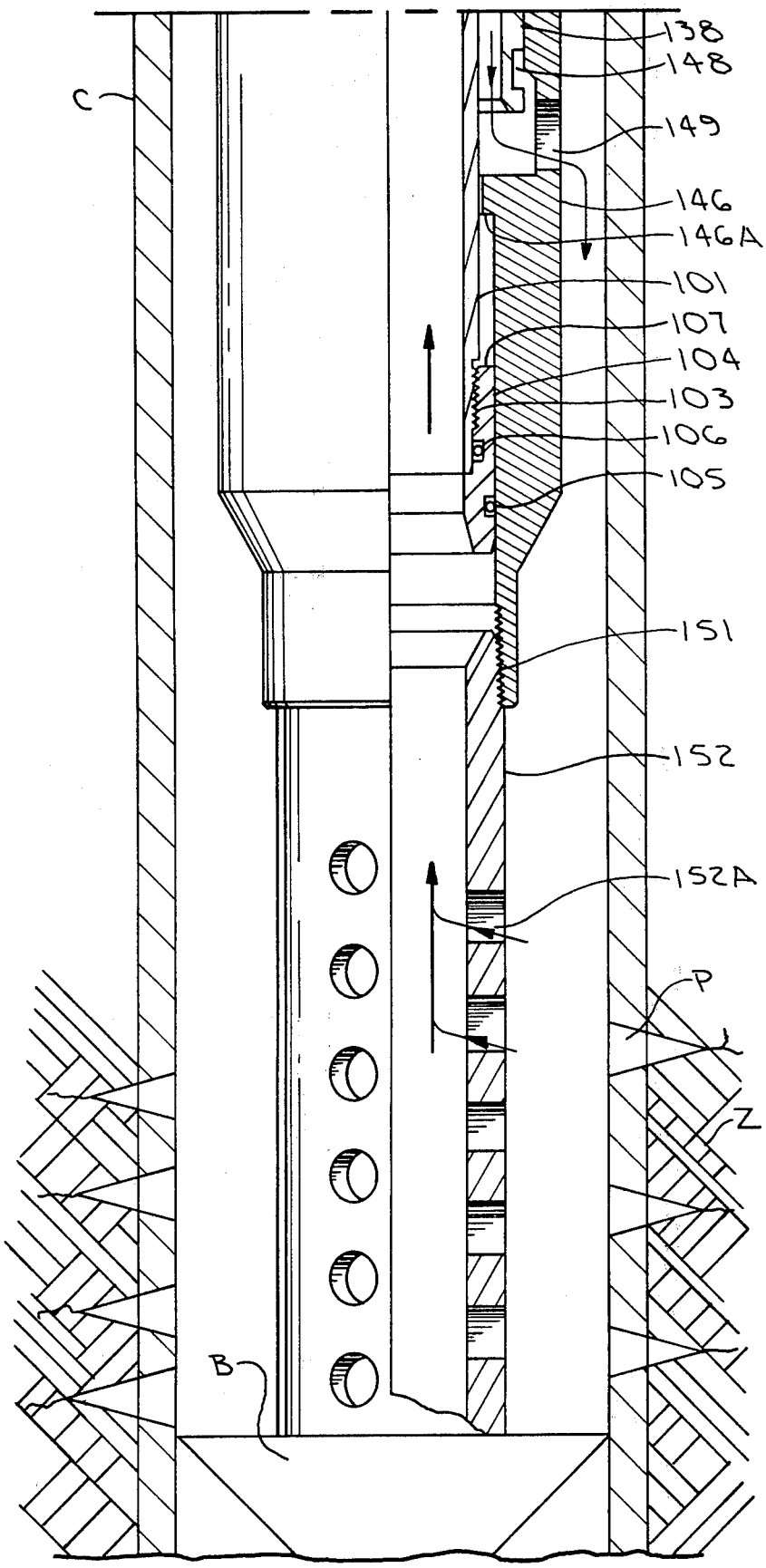

Now referring to FIG. 3B, a feature of the present invention is the ability to urge the hold-down buttons, as defined by the teeth 133 and 134, into anchoring engagement with the inner wall of the casing C, to prevent upward movement of the packer assembly 100, and inadvertent disengagement from sealing position of the packing elements 139, 140 and 141. If pressure below the port 149 is greater than that immediate the interior of the pistons 123 and 124, and within the short string T-1, and is also greater than the compressive force defined through the springs 129, 130, 131 and 132, the pistons 123 and 124 will be urged into expanded position and outwardly away from the long string mandrel 101, thus carrying the teeth 133 and 134 into anchoring engagement with the casing C. As the teeth 133 and 134 are secured into the interior wall of the casing C, upward movement of the packer assembly 100 relative to the casing C will be prevented, with downward movement, of course, being prevented by the no-go position of the apparatus A relative to the bottom B of the well.

Additionally, because of the utilization of the short string T-1, which communicates at the bore 116 to the passageway 115, the hold-down buttons, defined at the teeth 133 and 134, may be urged outwardly into gripping engagement with the interior wall of the casing C simply by application of increased pressure through the short string T-1 in excess of well pressure at the zone Z, and also in excess of the compressive force defined through the springs 129, 130, 131 and 132. Thus, as pressure is increased within the short string T-1, the pistons 123 and 124 will be urged outwardly away from the long string mandrel 101, thereby compressing the springs 129, 130, 131 and 132, and transferring this load to the teeth 133 and 134, whereby the teeth 133 and 134 come into gripping engagement with the inner wall of the casing C. The apparatus A now is anchored against upward longitudinal movement within the casing C.

Subsequent to the injection of inhibitor or artificial lift fluid through the apparatus A, and when it is desired to retrieve the apparatus A from the well, and assuming that the teeth on the buttons previously were urged to engaged position on the casing, the hold-down buttons are released from engaged position relative to the casing C by bleeding pressure at the top of the well from within the short string T-1. If necessary, pressure is applied in the tubing-casing annulus in excess of that below the packer assembly to assist the springs in contracting the hold-down buttons to released position. When pressure is bled off, as described above, the compressive force defined through the springs 129, 130, 131 and 132 will act upon the pistons 123 and 124 to move them inwardly toward the long string mandrel 101. As the springs 129, 130, 131 and 132 are expanded, the outwardly urging load on the teeth 133 and 134 is reduced, permitting the teeth to come out of gripping engagement with the inner wall of the casing C. The long string T-2 is picked up at the top of the well and shifted longitudinally upward. Now, the pickup shoulder 108 on the long string mandrel 101 will contact the lower bevel 112 of the dual string receptacle 109. Additionally, the upper shoulder 107 on the bottom cap 104 will become interengaged with the shoulder 146A of the lower mandrel 146, such that the packer assembly 100 may be picked up, as a unit, and retrieved from the top of the well.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. In an apparatus for injecting fluid within a bore and immediate a production zone of a subterranean well, said well having casing extending therein, said fluid being transmitted through said bore above said apparatus through parallel fluid flow conduits, the improvement comprising: a packer assembly communicating to said fluid flow conduits and carriable by at least one said conduit; concentric flow means through said packer assembly for transmission of fluid and communicating with said fluid flow conduits and said production zone; receptacle means on said packer assembly communicating between one of said fluid flow conduits and said concentric flow means; and fluid pressure responsive casing gripping means on said packer assembly responsive to each of: (1) predeterminable pressure increase from fluid flow from the top of the well within one of said flow conduits and (2) pressure within said well below said packer assembly, whereby said gripping means are urged to gripping engagement with said casing to prevent movement of said apparatus in one direction.

2. The improvement of claim 1 wheren said fluid pressure responsive casing gripping means comprise piston elements in fluid communication with said concentric flow means; and selectively expandable and contractable means extending to said piston means for urging said casing gripping means toward engagement with said casing when said piston means are moved in one direction, and for permitting said gripping means to shift away from gripping engagement with said casing when said piston means are moved in another direction.

3. In an apparatus for injecting fluid within a bore and immediate a production zone of a subterranean well, said well having casing extending therein, said fluid being transmitted through said bore above said apparatus through first and second parallel tubing strings extending from the top of the well to said apparatus, the improvement comprising: a packer assembly communicating to each of said first and second tubing strings and carriable on each of said tubing strings; concentric flow means through said packer assembly for transmission of fluid and communicating with each of said first and second tubing strings and said production zone; receptacle means on said packer assembly communicating between one of said first and second tubing strings and said concentric flow means; and fluid pressure responsive casing gripping means on said packer assembly responsive to each of: (1) predterminable pressure increase from fluid flow from the top of the well within one of said first and second tubing strings; and (2) within said well below said packer assembly, whereby said gripping means are urged to gripping engagement with said casing to prevent movement of said apparatus in one direction.

4. An apparatus for injecting fluid within a bore and immediate a production zone of a subterranean well, said well having casing extending therein, said fluid being transmitted through said bore above said apparatus through parallel fluid flow conduits, the improvement comprising: a side pocket mandrel; valve means within said mandrel carriable on one of said fluid flow conduits for selective injection of fluid therein; a packer assembly communicating to said fluid flow conduits and carriable by as least one said conduit; concentric flow means through said packer assembly for transmission of fluid and communicating with said fluid flow conduits and said production zone; receptacle means on said packer assembly communicating between one of said fluid flow conduits and said concentric flow means; and fluid pressure responsive casing gripping means on said packer assembly responsive to each of: (1) predeterminable pressure increase from fluid flow from the top of the well within one of said flow conduits; and (2) pressure within said well below said packer assembly, whereby said gripping means are urged to gripping engagement with said casing to prevent movement of said apparatus in one direction.

* * * * *